US011051603B2

(12) United States Patent
Suzuki

(10) Patent No.: US 11,051,603 B2
(45) Date of Patent: Jul. 6, 2021

(54) COSMETIC MATERIAL CONTAINER

(71) Applicant: TOKIWA CORPORATION, Nakatsugawa (JP)

(72) Inventor: Takumi Suzuki, Kawaguchi (JP)

( * ) Notice: Subject to any disclaimer, the term of this patent is extended or adjusted under 35 U.S.C. 154(b) by 551 days.

(21) Appl. No.: 16/109,756

(22) Filed: Aug. 23, 2018

(65) Prior Publication Data

US 2019/0059547 A1 Feb. 28, 2019

(30) Foreign Application Priority Data

Aug. 28, 2017 (JP) ..... JP2017-163178

(51) Int. Cl.
*A45D 33/36* (2006.01)
*A45D 34/04* (2006.01)
*A45D 40/26* (2006.01)

(52) U.S. Cl.
CPC ..... *A45D 34/045* (2013.01); *A45D 33/36* (2013.01); *A45D 34/043* (2013.01); *A45D 40/264* (2013.01); *A45D 40/265* (2013.01); *A45D 2200/05* (2013.01); *A45D 2200/1018* (2013.01)

(58) Field of Classification Search
CPC ..... A45D 33/36; A45D 2200/05; A45D 2200/1018; A45D 34/04; A45D 34/042; A45D 34/043; A45D 34/045; A45D 40/26; A45D 40/262; A45D 40/264; A45D 40/265
USPC ..... 401/123, 124, 126, 127, 128, 129, 130; 132/317, 293
See application file for complete search history.

(56) References Cited

U.S. PATENT DOCUMENTS

| | | | | |
|---|---|---|---|---|
| 5,116,154 | A | 5/1992 | Fulkerson | |
| 7,614,404 | B2 * | 11/2009 | Kee | A45D 40/265 132/218 |
| 9,986,811 | B2 * | 6/2018 | Yang | A45D 34/045 |
| 2015/0034113 | A1 | 2/2015 | Yamagishi et al. | |
| 2016/0022005 | A1 | 1/2016 | Suzuki | |

FOREIGN PATENT DOCUMENTS

| | | |
|---|---|---|
| CN | 1042297 | 5/1990 |
| CN | 204317828 | 5/2015 |
| CN | 105266343 | 1/2016 |
| JP | 2016-022260 | 2/2016 |
| WO | 2013/077284 | 5/2013 |

* cited by examiner

*Primary Examiner* — David J Walczak
(74) *Attorney, Agent, or Firm* — Soei Patent & Law Firm

(57) ABSTRACT

A lid is detached from a container main body, a mobile body and an application body are moved forward by an elastic body so as to move a mobile body side stepped portion toward a lid side stepped portion. An inclined tilt portion tilting downward as the inclined tilt portion goes inward in the radial direction on a stepped surface forming the stepped portion is positioned on the lid side stepped portion. The mobile body side stepped portion is moves forward, and the mobile body side stepped portion and a tile surface of the inclined tilt portion are caused to collide with each other so that the application body reaches a forward movement limit.

18 Claims, 9 Drawing Sheets

COSMETIC MATERIAL CONTAINER

CROSS-REFERENCE TO RELATED APPLICATION

This application is based upon and claims the benefit of priority from Japanese Patent Applications No. P2017-163178, filed on Aug. 28, 2017, the entire contents of which are incorporated herein by reference.

TECHNICAL FIELD

A cosmetic material container.

BACKGROUND

A cosmetic material container is known in which a lid is detachably attached to a container main body and an application body is disposed in the lid as disclosed in Japanese Unexamined Patent Publication No. 2016-22260. This cosmetic material container includes a container main body internally provided with a cosmetic material, the lid detachably attached to an upper portion of the container main body by means of screwing, an application body for applying the cosmetic material while being disposed in the lid so as to be movable in an axial direction, a sleeve portion serving as a mobile body which holds the application body and which is movable with respect to the lid in an upward-downward direction, and a coil spring serving as an elastic body which is interposed between the lid and the sleeve portion so that the sleeve portion is biased against the container main body side. Then, when the lid is attached to the container main body, the application body and the cosmetic material are separated from each other. In conjunction with an operation for detaching the lid from the container main body, the application body moves forward to the container main body side, and the cosmetic material comes into contact with the application body. In this manner, the cosmetic material adheres to the application body. The application body to which the cosmetic material adheres is used so that the cosmetic material can be applied to the application target portion. After the application body is used, the lid is attached to the container main body in conjunction with an operation for attaching the lid to the container main body, and the application body moves rearward to an upper portion (side opposite to the container main body). In this manner, the application body and the cosmetic material are separated from each other, thereby preventing the application body from being damaged when not in use.

Here, the lid includes a cylindrical gripping portion which is rotationally operated by a user, and a cylinder joining tool which is synchronously rotatable around an axis with respect to the gripping portion and which is movable in the axial direction. A lower end portion of the joining tool is provided with a flange-shaped stepped portion which annularly protrudes inward in a radial direction, as a lid side stepped portion. On the other hand, an outer peripheral surface in an intermediate portion in the axial direction of the sleeve portion is provided with a flange-shaped stepped portion which annularly protrudes outward in the radial direction and which faces the lid side stepped portion while being separated from the lid side stepped portion in the upward-downward direction, as a mobile body side stepped portion.

Thereafter, when the lid is detached from the container main body and is used in the cosmetic material container, due to a biasing force of the coil spring, the application body and the sleeve portion are further moved from a lid attached position where the application body and the sleeve portion are in contact with the cosmetic material of the container main body, to a forward movement limit which is set forward. As illustrated in FIG. 2 in Japanese Unexamined Patent Publication No. 2016-22260, the stepped portion on the forward moving mobile body side (sleeve portion) comes into contact with the stepped portion serving as a stopper on the lid side (joining tool). In this manner, the application body and the sleeve portion reaches the forward movement limit. In this state, the cosmetic material is applied to the application target portion by the application body.

SUMMARY

According to the above-described cosmetic material container of Japanese Unexamined Patent Publication No. 2016-22260, the mobile body side stepped portion comes into contact with the lid side stepped portion. In a state where the application body reaches a position of the forward movement limit, the application is performed using the cosmetic material by lightly tapping the application body on the application target portion, for example, such as a face of the user. Incidentally, if the application target portion such as the face is tapped by the application body, the application body and the sleeve portion move rearward once from the forward movement limit against the biasing force of the coil spring. However, the application body and the sleeve portion are immediately pushed back to the forward movement limit due to the biasing force of the coil spring. When in use, the application body repeatedly moves forward and rearward. If the application body repeatedly moves forward and rearward in this way, a contact sound of "click!" is repeatedly generated, since the lid side stepped portion and the mobile body side stepped portion come into contact with each other. Consequently, many users occasionally feel uncomfortable as a result of the contact sound.

Disclosed herein is a cosmetic material container which applies makeup on an application target portion by pushing an application body located in a forward movement limit, for example, so as to tap or otherwise apply the application body to the application target portion, and in which the application body moves rearward from the forward movement limit and is pushed back to the forward movement limit by an elastic body while application is performed. The cosmetic material container is configured to reduce and suppress a contact sound generated when the application body moves forward and reaches the forward movement limit.

The cosmetic material container may include a container main body that is internally provided with a cosmetic material, a lid that is removably attachable to an upper portion of the container main body, an application body for applying the cosmetic material, a mobile body that holds the application body, and that is supported so as to be movable with respect to the lid in an upward-downward direction, and an elastic body that is interposed between the lid and the mobile body so that the mobile body is biased against the container main body side. The lid has a lid side stepped portion which is disposed on a lower side of the lid, and which protrudes inward in a radial direction. The mobile body has a mobile body side stepped portion which faces the lid side stepped portion while being separated from the lid side stepped portion in the upward-downward direction. In either one of the lid side stepped portion and the mobile body side stepped portion, an inclined intermediate portion tilting downward as the inclined intermediate portion goes inward in the radial direction is disposed on a stepped surface forming the stepped portion. If the lid is detached from the container main body, the application body and the mobile body are moved forward from a lid attached position by the elastic body. In one or more examples, either one of the lid side stepped portion and the mobile body side stepped portion may therefore be configured to collide with the tilt surface of the inclined intermediate portion so as to set a forward movement limit of the application body.

In some examples, if the lid is detached from the container main body, the mobile body and the application body of the lid are moved forward from the lid attached position by the elastic body. Accordingly, the mobile body side stepped portion facing the lid side stepped portion, while being separated from the lid side stepped portion in the upward-downward direction, may be configured to move toward the lid side stepped portion disposed on the lower end side of the lid and protruding inward in the radial direction. In some examples, in either one of the lid side stepped portion and the mobile body side stepped portion, the inclined intermediate tilt portion tilting downward as the inclined intermediate portion goes inward in the radial direction is disposed on the stepped surface forming the stepped portion. Therefore, if the mobile body side stepped portion moves forward, either one of the lid side stepped portion and the mobile body side stepped portion may be configured to collide with the inclined surface of the inclined intermediate portion. In this manner, the application body reaches the forward movement limit so that the application can be performed. Here, line contact in which a corner portion of the stepped portion and the tilt surface collide with each other reduces a contact area, compared to containers which provide surface contact between the stepped portions. Accordingly, the contact sound can be reduced. If the corner portion of the stepped portion collides with the tilt surface, a contact force generated by the corner portion of the stepped portion coming into contact with the tilt surface and acting in a vertical direction is divided into a force acting in a tilt direction along the tilt surface and a force of vertically pushing the tilt surface, such that the force associated with vertically pushing the tilt surface may be decreased. For example, the force is decreased compared to containers in which the stepped portion vertically pushes the counterpart side stepped portion. Accordingly, the contact sound can be further reduced. Consequently, the force of vertically pushing the tilt surface can be reduced based, at least in part, on the gradient or angle of the tilt surface, and the contact sound can be further suppressed.

The cosmetic material container may include a container main body that is configured to have a cylindrical shape whose one end is closed, that has a first screw portion disposed on a cylinder wall, and that includes a cosmetic material. Additionally, the cosmetic material container may include a lid that is configured to have a cylindrical shape whose one end is closed, that has a second screw portion disposed on a cylinder wall so as to be screwable to the first screw portion, and that includes an application body. The first and second screw portions are screwed to each other so that the lid is detachably attached to the container main body. The lid includes a joining tool that has the second screw portion, and that has a guide portion for guiding the application body, and a gripping portion that is rotationally operated by a user so as to be immovable in an axial direction with respect to the joining tool, and so as to be rotatable around an axis with respect to the joining tool. Additionally, the lid may include a lid side stepped portion that is disposed on a lower end side of the joining tool, and that protrudes inward in a radial direction, and a mobile body that is integrated with the application body. In some examples, the mobile body has a sleeve portion which is movable in the axial direction with respect to the gripping portion and which is synchronously rotatable around the axis with the gripping portion. The lid may also include a stopper portion which is synchronously rotated with the sleeve portion, which has a guide object portion guided to the guide portion by rotating the gripping portion, and which moves in the axial direction. Additionally, the lid may include a mobile body side stepped portion that is disposed on an outer periphery of the sleeve portion, and that faces the lid side stepped portion while being separated from the lid side stepped portion in the axial direction, and an elastic body that is interposed between the gripping portion and the sleeve portion so that the sleeve portion is biased against the container main body side. In some examples, in either one of the lid side stepped portion and the mobile body side stepped portion, a inclined intermediate tilt portion tilting downward as the inclined intermediate portion goes inward in the radial direction is disposed on a stepped surface forming the stepped portion. When the lid is attached to the container main body, the stopper portion, the sleeve portion, and the application body are pulled back to a rearward movement limit, and the cosmetic material and the application body are separated from each other. If the lid is rotationally operated in a direction in which the lid is detached from the container main body, the guide object portion of the stopper portion is guided to the guide portion of the joining tool, and the stopper portion, the sleeve portion, and the application body are moved to the container main body side so that the cosmetic material and the application body come into contact with each other. If the rotational operation is continuously operated in the same direction, the gripping portion and the joining tool are integrated with each other, a screwing operation is performed between the first and second screw portions so that the lid is detached from the container main body, and the sleeve portion is biased to a forward movement limit located in a direction different from that of the rearward movement limit by the elastic body. Accordingly, either one of the lid side stepped portion and the mobile body side stepped portion may be configured to collide with a tilt surface of the inclined intermediate portion so that the application body reaches the forward movement limit. If the lid is rotationally operated in a direction in which the lid is detached to the container main body, the screwing operation is performed between the first and second screw portions so that the lid is attached to the container main body. If the screwing operation is stopped between the first and second screw portions, the gripping portion and the joining tool become rotatable, and the guide object portion of the stopper portion is guided to the guide portion of the joining tool. In some examples, the stopper portion, the sleeve portion, and the application body are all pulled back to the rearward movement limit so that the cosmetic material and the application body are separated from each other.

In some examples, when the lid is attached to the container main body, the cosmetic material and the application body are separated from each other. If the lid is rotationally operated in a direction in which the lid is detached from the container main body, the guide object portion of the stopper portion synchronously rotated with the gripping portion is first guided to the guide portion of the joining tool, and is biased by the elastic body. The stopper portion, the sleeve portion (mobile body), and the application body are moved to the container main body side, and the cosmetic material and the application body come into contact with each other.

Subsequently, the screwing operation is performed between the first and second screw portions so that the lid is detached from the container main body. Therefore, without needing a special operation, a proper amount of the cosmetic material can adhere to the application body in conjunction with the operation for detaching the lid from the container main body. If the lid is rotationally operated in a direction in which the lid is attached to the container main body, the screwing operation is first performed between the first and second screw portions so that the lid is attached to the container main body. Subsequently, the guide object portion of the stopper portion synchronously rotated with the gripping portion is guided to the guide portion of the joining tool, and the stopper portion, the sleeve portion (mobile body), and the application body are moved in a direction opposite to the above-described direction so that the cosmetic material and the application body are separated from each other. Therefore, without needing a special operation, the application body can be prevented from being damaged, in conjunction with the operation for attaching the lid to the container main body. Then, if the lid is detached from the container main body, the mobile body and the application body are moved forward from the lid attached position by the elastic body. Accordingly, the mobile body side stepped portion facing the lid side stepped portion, while being separated from the lid side stepped portion in the upward-downward direction, may be configured to move toward the lid side stepped portion disposed on the lower end side of the joining tool and protruding inward in the radial direction. In either one of the lid side stepped portion and the mobile body side stepped portion, the inclined intermediate tilt portion tilting downward as the inclined intermediate portion goes inward in the radial direction is disposed on the stepped surface forming the stepped portion. Therefore, if the mobile body side stepped portion moves forward, either one of the lid side stepped portion and the mobile body side stepped portion may be configured to collide with the tilt surface of the inclined intermediate portion. In this manner, the application body reaches the forward movement limit so that the application can be performed. Here, line contact in which the corner portion of the stepped portion and the tilt surface collide with each other reduces the contact area, compared to containers which provide surface contact between the stepped portions. Accordingly, the contact sound can be reduced. If the corner portion of the stepped portion collides with the tilt surface, the contact force generated by the corner portion of the stepped portion coming into contact with the tilt surface and acting in the vertical direction is divided into the force acting in the tilt direction along the tilt surface and the force of vertically pushing the tilt surface, and the force of vertically pushing the tilt surface is weakened. The force is weakened, compared to containers in which the stepped portion vertically pushes the counterpart side stepped portion. Accordingly, the contact sound can be further suppressed. Consequently, the force of vertically pushing the tilt surface can be reduced based, at least in part, on the gradient or angle of the tilt surface, and thus the contact sound can be further suppressed.

In some examples, the inclined intermediate portion may be disposed on a stepped surface of the lid side stepped portion, and may tilt downward as the inclined intermediate portion goes inward in the radial direction. The forward moving mobile body side stepped portion and the tilt surface of the inclined intermediate portion may collide with each other so as to set the forward movement limit of the application body.

In addition, the inclined intermediate portion may be disposed on a stepped surface of the mobile body side stepped portion, and may tilt downward as the inclined intermediate portion goes inward in the radial direction. The forward moving lid side stepped portion and the tilt surface of the inclined intermediate portion may collide with each other so as to set the forward movement limit of the application body.

In addition, if a plurality of the tilt portions are disposed separate from each other along a circumferential direction of the stepped portion, only a few contact locations are formed between the stepped portion and the tilt surface. Accordingly, contact sound generating locations can be reduced, and the contact sound can be further suppressed.

In addition, the inclined intermediate portion may be annularly disposed so as to be continuous along a circumferential direction of the stepped portion. In this case, the contact area is also reduced by the line contact, compared to containers which provide the surface contact between the stepped portions. Accordingly, the contact sound can be reduced. In addition, compared to the force generated by the stepped portion vertically pushing the counterpart side stepped portion, the force of vertically pushing the tilt surface can be reduced, and thus, the contact sound can be suppressed.

Accordingly, the cosmetic material container may be configured to reduce and suppress the contact sound generated when the application body moves forward and reaches the forward movement limit.

DETAILED DESCRIPTION

Figure 1:
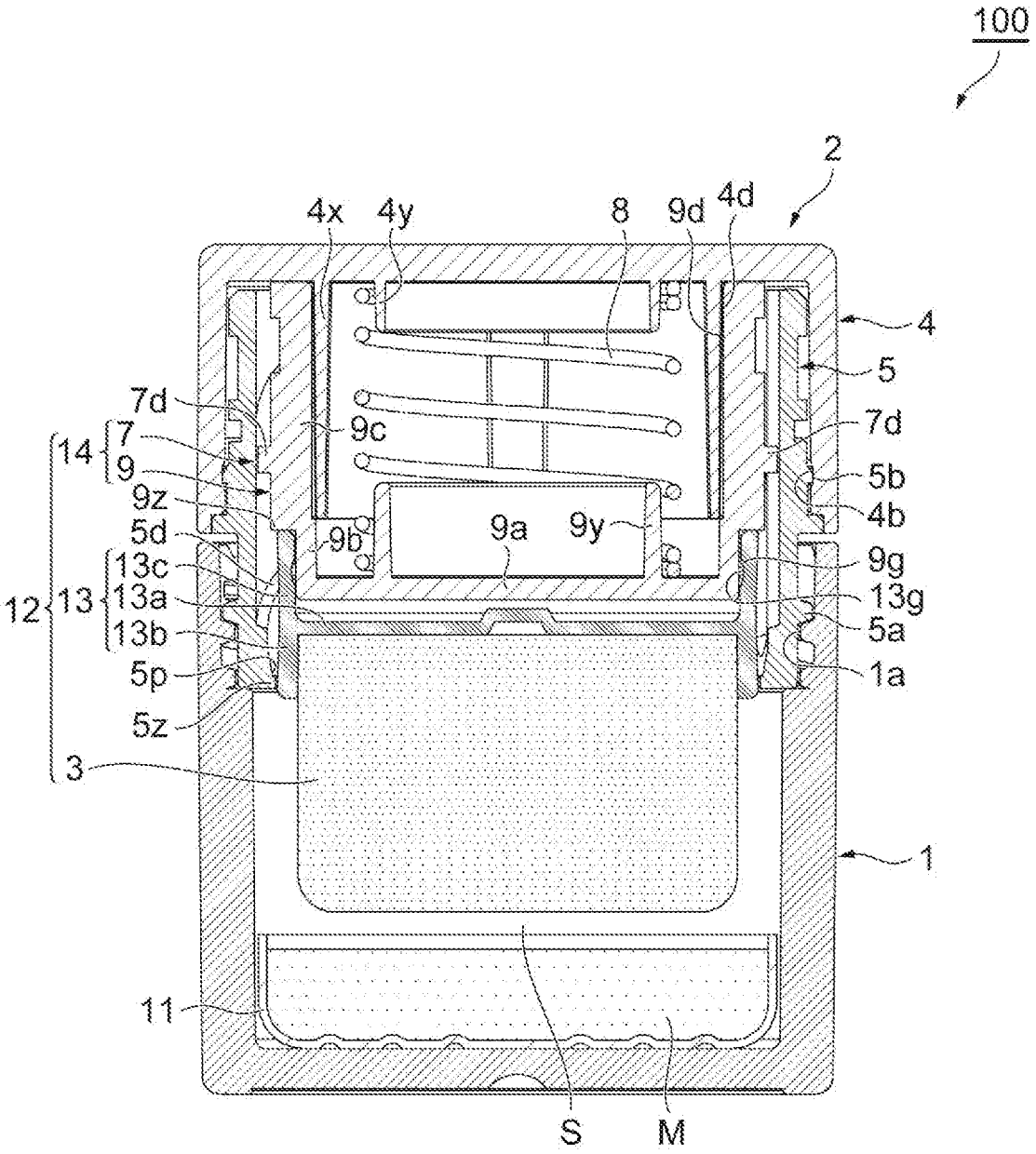
FIG. 1 is a longitudinal sectional view illustrating an initial state of an example cosmetic material container.
Figure 2:
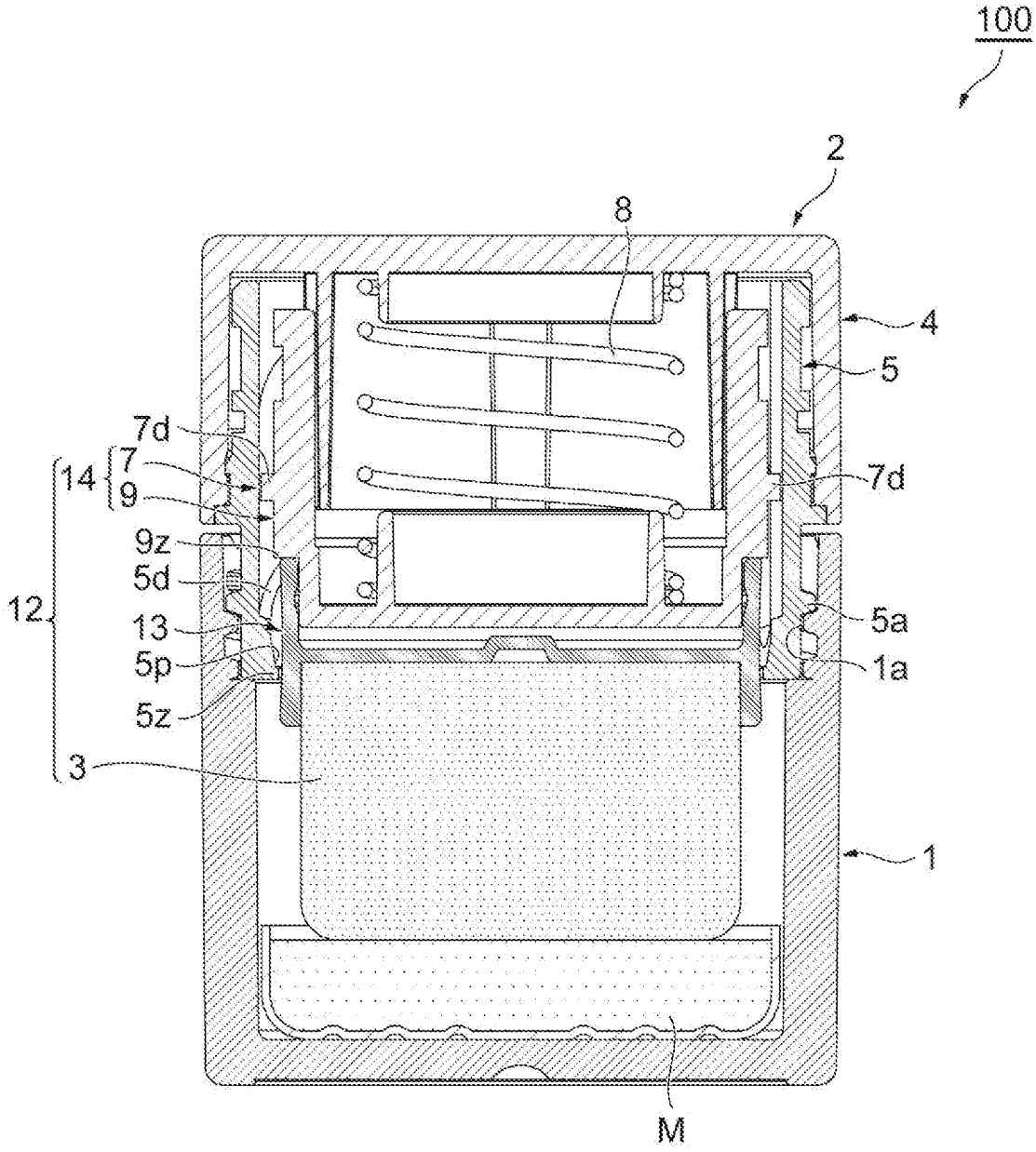
FIG. 2 is a longitudinal sectional view of the cosmetic material container, which illustrates a state where an application body is in contact with a cosmetic material.
Figure 3:
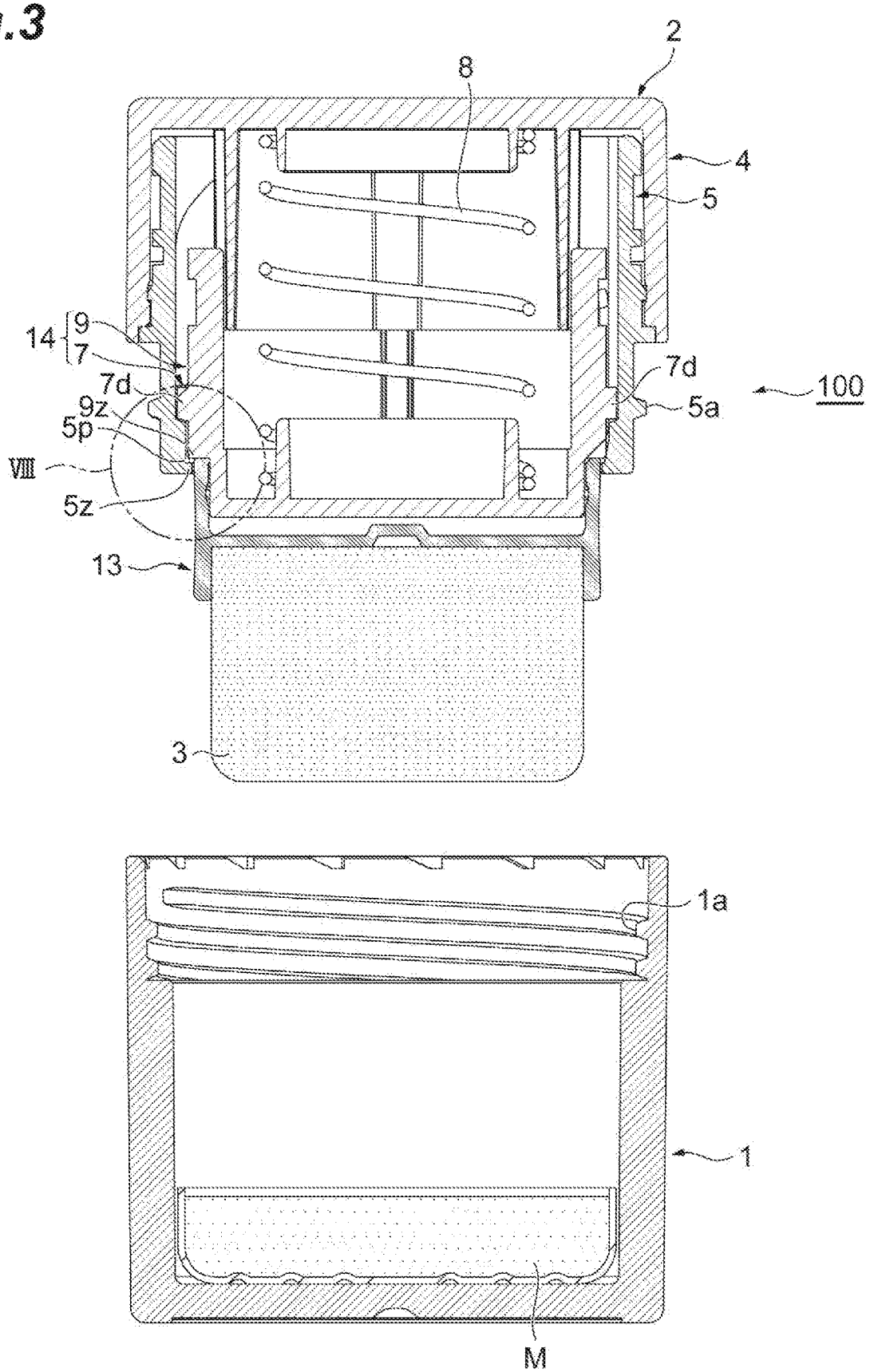
FIG. 3 is a longitudinal sectional view illustrating a state where a lid is detached from a container main body.
Figure 4:
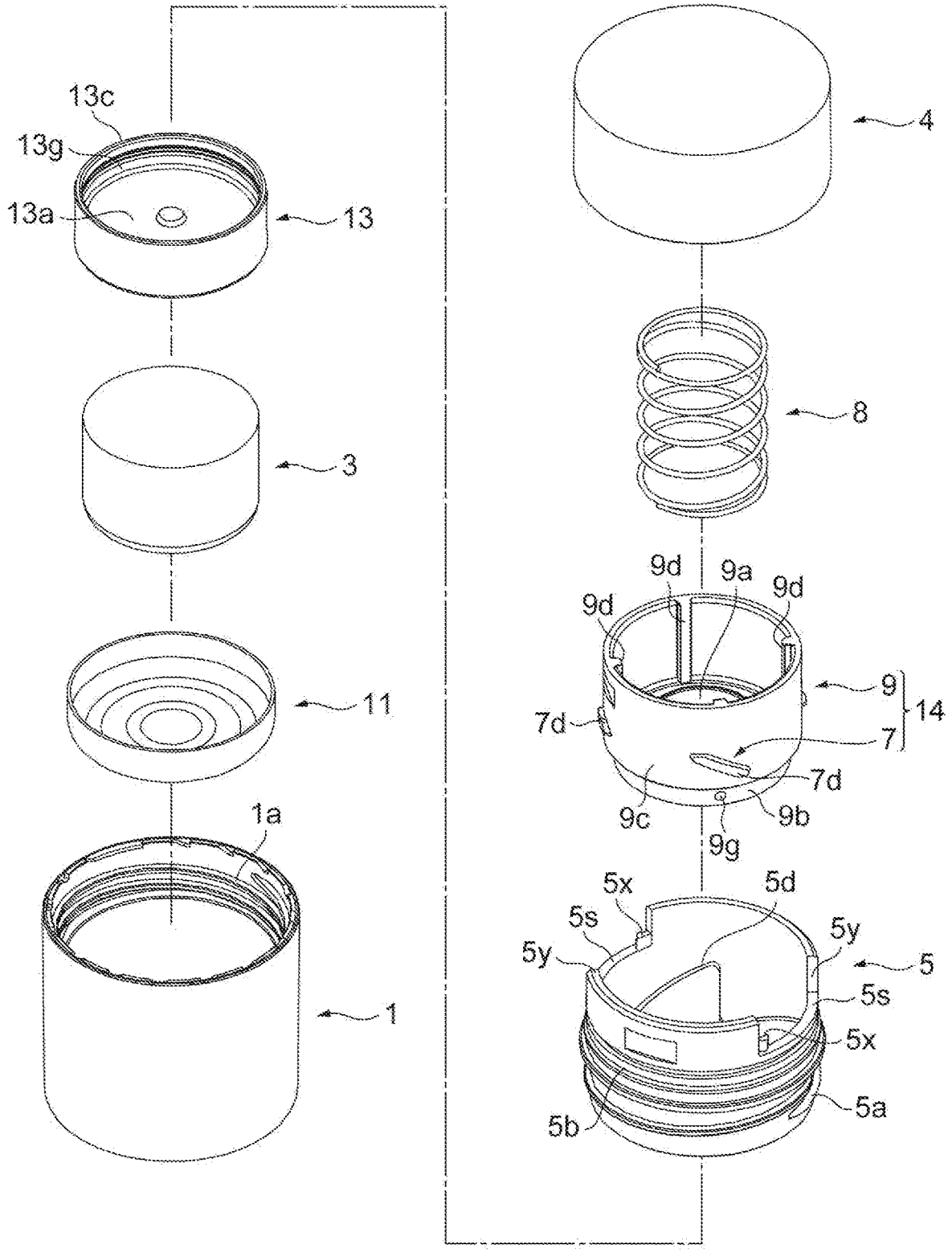
FIG. 4 is an exploded perspective view when the cosmetic material container illustrated in FIG. 1 is viewed from an upper side.
Figure 5:
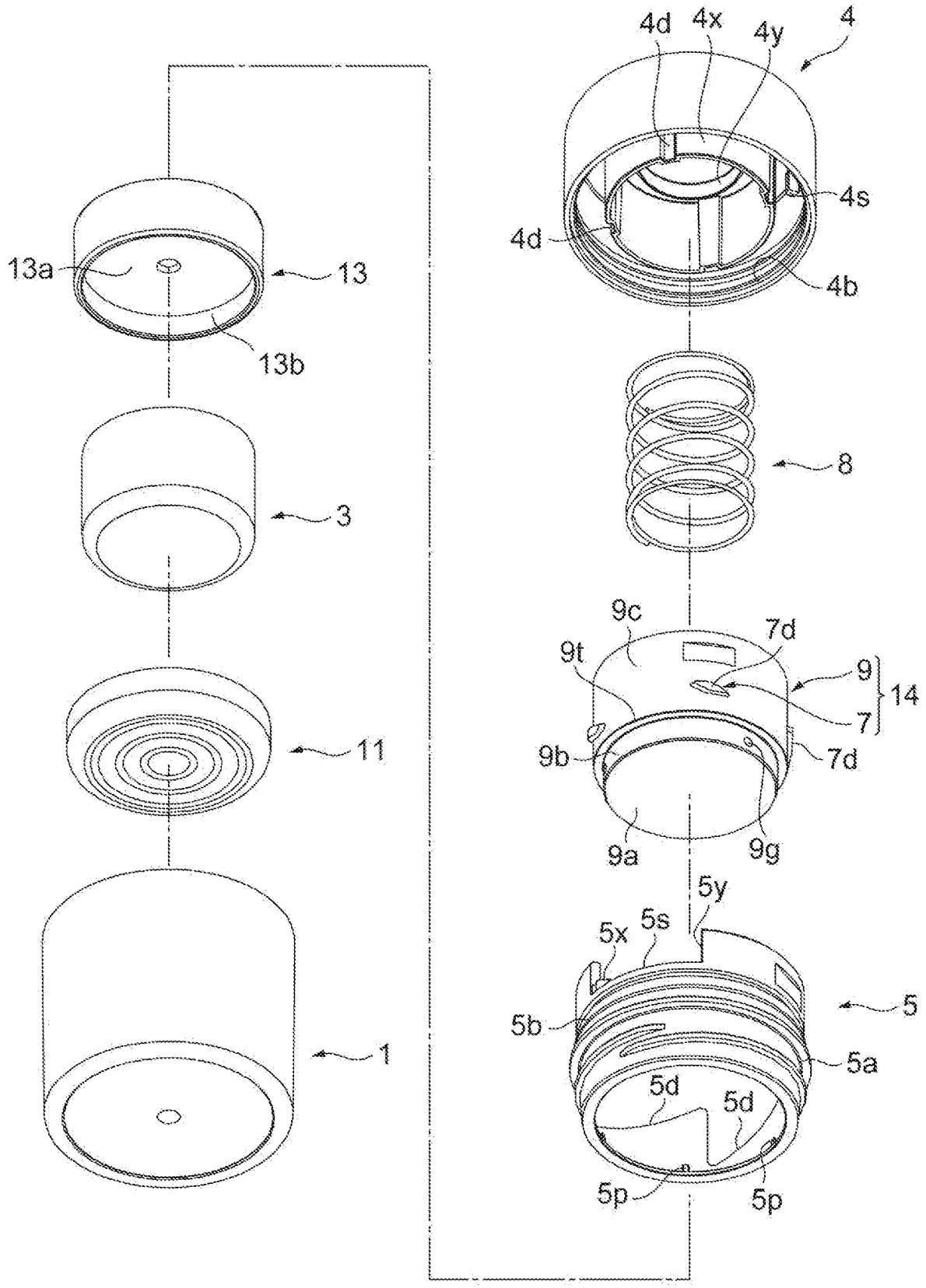
FIG. 5 is an exploded perspective view when the cosmetic material container illustrated in FIG. 1 is viewed from a lower side.
Figure 6:
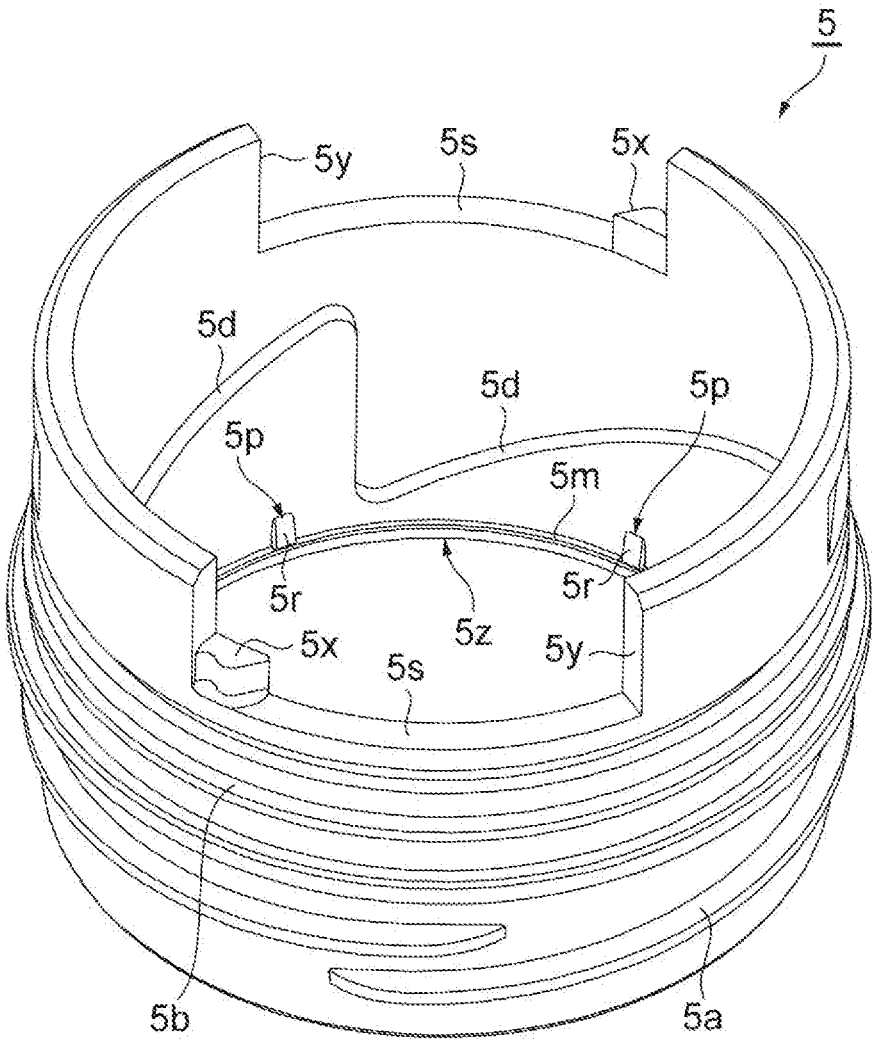
FIG. 6 is a perspective view when a joining tool is viewed from above.
Figure 7:
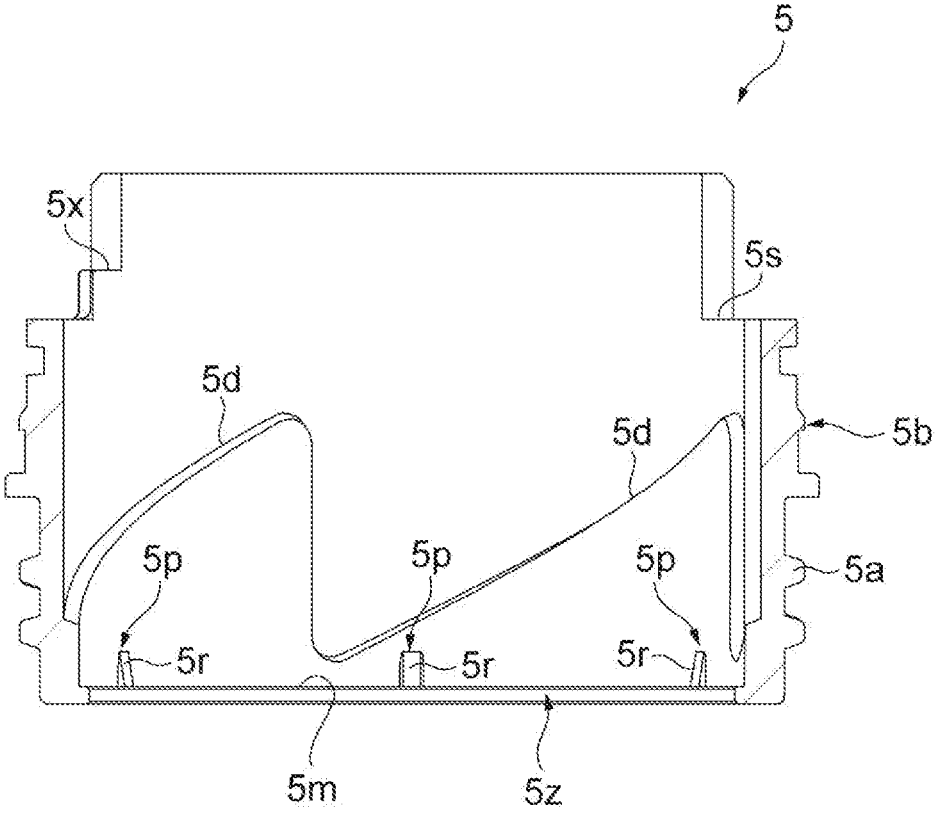
FIG. 7 is a longitudinal sectional view of the joining tool.
Figure 8:
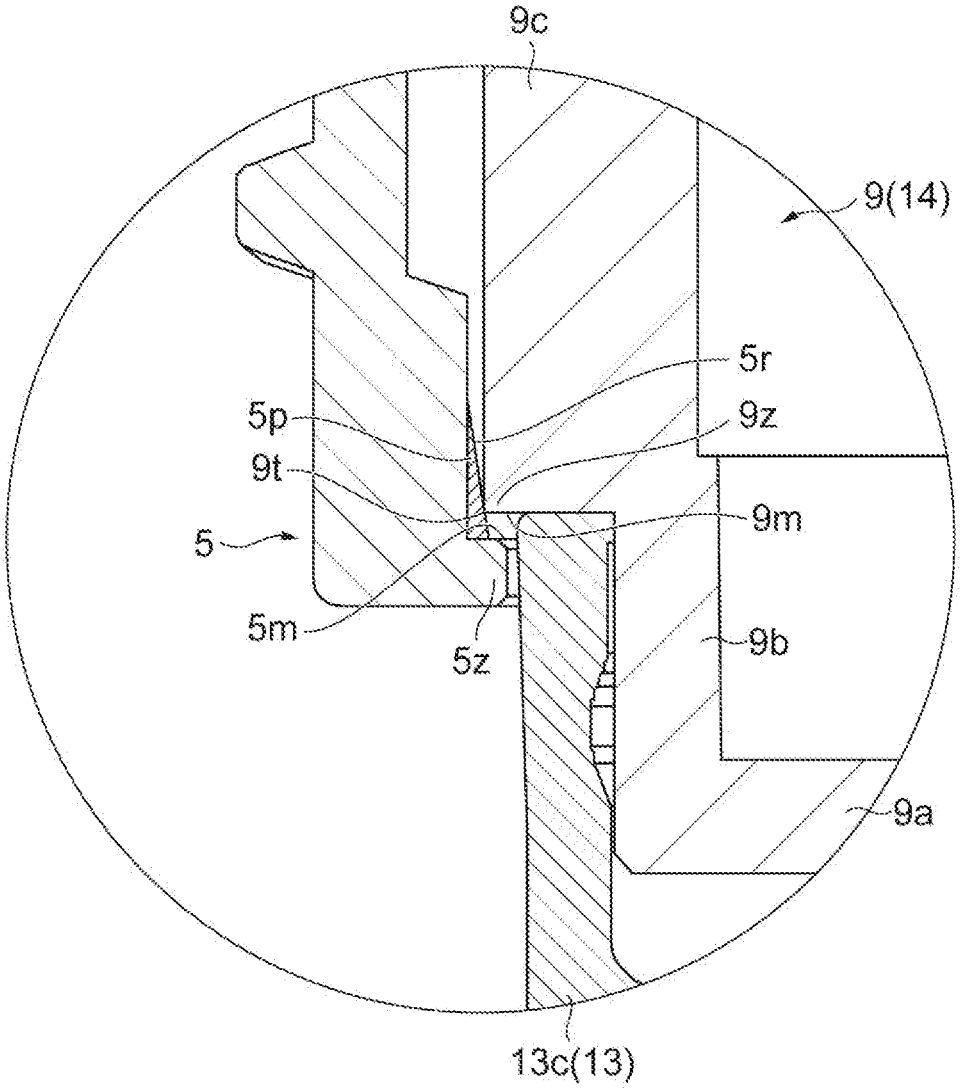
FIG. 8 is an enlarged view of a portion VIII illustrated in FIG. 3.

In the following description, with reference to the drawings, the same reference numbers are assigned to the same components or to similar components having the same function, and overlapping description is omitted. FIG. 1 is a longitudinal sectional view illustrating an initial state of an example cosmetic material container. FIG. 2 is a longitudinal sectional view illustrating the cosmetic material container, which illustrates a state where an application body is in contact with a cosmetic material. FIG. 3 is a longitudinal sectional view illustrating a state where a lid is detached from a container main body. FIGS. 4 and 5 are exploded perspective views when the cosmetic material container is viewed from an upper side or a lower side. FIGS. 6 and 7 respectively illustrate a joining tool. FIG. 8 is an enlarged view of a portion VIII illustrated in FIG. 3.

As illustrated in FIG. 1, a cosmetic material container 100 can be used when a cosmetic material M is applied on a user's face, for example. The cosmetic material M and an application body 3 are internally accommodated. The cosmetic material M adheres to the application body 3 when a lid 2 is open. When the lid 2 is closed, the application body 3 and the cosmetic material M are in a non-contact state. Hereinafter, a configuration thereof will be described in detail. The term of up and down will be used, based on an orientation of the drawings.

By way of example only, the cosmetic material M may comprise a cosmetic material obtained by solidifying a powder cosmetic material or a creamy cosmetic material.

The cosmetic material container 100 includes a container main body 1 that accommodates the cosmetic material M, and the lid 2 that covers the container main body 1 from above, and that is detachably attached to an upper portion of the container main body 1.

As illustrated in FIGS. 1, 4, and 5, the container main body 1 is configured to have a cylindrical shape whose one end is closed at the bottom, and includes an accommodation space for accommodating the cosmetic material M in a lower portion inside a cylinder wall. A cosmetic material accommodation portion 11 accommodating the cosmetic material M is located in the accommodation space. The cosmetic material accommodation portion 11 is configured to have a cylindrical shape, and internally accommodates the cosmetic material M. An upper cylinder wall of the container main body 1 has a screw portion (first screw portion) 1*a* for attaching the lid 2 which is disposed so as to extend in an axial direction along a circumferential direction. Here, the screw portion 1*a* is a female screw formed on an inner peripheral surface of the upper cylinder wall.

The lid 2 includes the application body 3 for applying the cosmetic material M, and further includes a gripping portion 4 functioning as a lid and rotationally operated while being gripped by a user. Additionally, the lid 2 includes a joining tool 5 engaging with the gripping portion 4 and detachably engaging with the container main body 1, a mobile body 14 having a stopper portion 7 moving in the axial direction of the lid 2 in response to the rotation of the gripping portion 4 and a sleeve portion 9 moving in the axial direction together with the stopper portion 7. Still further, the lid 2 may include an application body holder 13 holding the application body 3, and an elastic body 8 which biases an application tool 12 having the application body 3, the application body holder 13, and the mobile body 14 against the container main body 1 side. In some examples, the elastic body 8 may comprise a compression coil spring.

The gripping portion 4 is configured to have a short cylindrical shape whose one end is closed at the top, and is located so as to face the container main body 1. An inner peripheral surface of the cylinder wall of the gripping portion 4 is provided with an annular recess 4*b* for engaging with the joining tool 5 in the axial direction. A bottom portion of the gripping portion 4 has a cylindrical protruding portion 4*x* protruding toward the container main body 1 side. An outer peripheral surface of the cylinder wall of the protruding portion 4*x* is provided with a plurality of (here, four) recessed grooves 4*d* extending in the axial direction. The plurality of recessed grooves 4*d* are disposed along the circumferential direction in order to engage with the sleeve portion 9 in a rotation direction. In addition, the bottom portion of the gripping portion 4 is provided with an elastic body guide 4*y* having a smaller diameter than the protruding portion 4*x* and extending downward a short distance. The elastic body guide 4*y* is used for aligning the elastic body 8. The elastic body 8 is located so that an upper portion thereof surrounds the elastic body guide 4*y*. An inner surface on an outer edge of the bottom portion of the gripping portion 4 is provided with a pair of projections 4*s* facing each other and bought into contact with end portions 5*x* and 5*y* of a cutout portion 5*s* of the joining tool 5 by the rotation of the gripping portion 4.

As illustrated in FIGS. 1 and 4 to 7, the joining tool 5 is configured to have a cylindrical shape. A screw portion (second screw portion) 5*a* screwable to the screw portion 1*a* of the container main body 1 is disposed along the circumferential direction, on the container main body 1 side of the cylinder wall of the joining tool 5. Here, the screw portion 5*a* is a male screw formed on the outer peripheral surface. An annular projection 5*b* is disposed on an outer peripheral surface on the gripping portion 4 side from the screw portion 5*a* of the joining tool 5 so as to engage with the recess 4*b* of the gripping portion 4 in the axial direction. Four sloped structures tilting in a spiral shape in the axial direction are continuously disposed along the circumferential direction, as guide portions 5*d* for guiding the stopper portion 7, on an inner peripheral surface on the gripping portion 4 side from the screw portion 5*a* of the joining tool 5. Specifically, as illustrated in FIGS. 4 to 7, the sloped structures serving as the guide portions 5*d* tilt downward along the circumferential direction from an upper end side below the cutout portion 5*s*. The sloped structures extend toward a lower end of the joining tool 5 in an arc shape. If the sloped structures reach the vicinity of the lower end of the joining tool 5 (near a stepped portion 5*z* to be described later), the sloped structures vertically rise to the upper end side of the joining tool 5, and the downward and rising portions of the sloped structures are repeated in the circumferential direction.

On an upper end surface of the joining tool 5, the cutout portion 5*s* cut out downward along the circumferential direction and having an arc shape in a plan view is disposed at a pair of positions facing each other. The projection 4*s* of the gripping portion 4 enters the cutout portion 5*s*, and the projection 4*s* of the gripping portion 4 is brought into contact with one end portion 5*x* of the cutout portion 5*s* by the rotation of the gripping portion 4. From this time, the gripping portion 4 and the joining tool 5 can be integrally rotated in one direction. When the projection 4*s* of the gripping portion 4 is brought into contact with the other end portion 5*y* of the cutout portion 5*s* by the reverse rotation of the gripping portion 4, the application body 3 reaches a rearward movement limit.

As illustrated in FIGS. 6 to 8, as a lid side stepped portion, the flange-shaped stepped portion 5*z* which annularly protrudes inward in the radial direction is disposed in the lower end of the joining tool 5. In the lid side stepped portion 5*z*, an inclined tilt portion 5*p* is disposed on a stepped surface 5*m* forming the stepped portion. Here, the inclined tilt portions 5*p* are arranged at six positions with an equal interval along the circumferential direction. The upper end of the inclined tilt portion 5*p* is disposed to be continuous with the inner peripheral surface of the joining tool 5 located above the stepped surface 5*m* of the lid side stepped portion 5*z*. The lower end of the tilt portion 5*p* is disposed to be continuous with the stepped surface 5*m* of the joining tool 5, and the inclined tilt portion 5*p* has a gradient tilting downward as the inclined tilt portion 5*p* goes inward in the radial direction. A tilt surface 5*r* of the inclined tilt portion 5*p* functions as a forward movement limit of the sleeve portion 9 (mobile body 14) (details will be described later).

As illustrated in FIGS. 1, 4, and 5, the sleeve portion 9 of the mobile body 14 is configured to have a cylindrical shape whose one end is closed, and includes a bottom portion 9*a*, a relatively short lower cylindrical portion 9*b* erected on the upper surface of the outer peripheral portion of the bottom portion 9*a*, and an upper cylindrical portion 9*c* disposed to be continuous with the upper portion of the lower cylindrical portion 9*b* via a stepped portion 9*z*. The diameter of the stepped portion 9*z* increases toward the outer peripheral side of the sleeve portion 9. As illustrated in FIG. 8, the stepped portion 9*z* is disposed as a mobile body side stepped portion which connects the upper cylindrical portion 9*c* and the lower cylindrical portion 9*b* to each other by decreasing the diameter via the stepped surface 9*m*. As illustrated in FIG. 1, the lid side stepped portion 5*z* is located at a position facing the mobile body side stepped portion 9*z* while being separated downward therefrom.

A relatively short elastic body guide 9*y* (refer to FIG. 1) having a smaller diameter than the cylindrical portions 9*b* and 9*c* and extending upward from the bottom portion 9*a* is erected at the center of the upper surface of the bottom portion 9*a*. The elastic body guide 9*y* is provided for aligning the elastic body 8, is disposed below the elastic body guide 4*y* of the gripping portion 4 so as to face the elastic body guide 4*y*, and is surrounded by the lower portion of the elastic body 8, thereby aligning the elastic body 8. That is, the upper portion of the elastic body 8 is guided by the elastic body guide 4*y*, and the lower portion of the elastic body 8 is guided by the elastic body guide 9*y*. In this manner, the elastic body 8 is interposed between the gripping portion 4 and the bottom portion 9*a* of the sleeve portion 9 so as to accumulate a biasing force.

As illustrated in FIGS. 1, 4, and 5, the inner peripheral surface of the upper cylindrical portion 9*c* is provided with a plurality of (here, four) projection threads 9*d* extending in the axial direction. The projection threads 9*d* are disposed along the circumferential direction so as to respectively engage with the recessed grooves 4*d* of the gripping portion 4 in a rotation direction. The outer peripheral surface of the lower cylindrical portion 9*b* is provided with a plurality of hemispherical projections 9*g* for fixing the application body holder 13, which are disposed separate from each other in the circumferential direction (refer to FIGS. 4 and 5).

The stopper portion 7 of the mobile body 14 includes a plurality of (here, four) guide object portions 7*d* disposed on the outer peripheral surface of the sleeve portion 9. The guide object portions 7*d* are guided by the guide portions 5*d* of the joining tool 5, and the guide object portions 7*d* are arranged separate from each other at four positions with an equal interval along the circumferential direction so as correspond to the guide portions 5*d* of the joining tool 5. The respective guide object portions 7*d* ride on the respective guide portions 5*d* of the joining tool 5, and function as angled projections which can slide on the guide portions 5*d* serving as tilting slopes.

As illustrated in FIGS. 1, 4, and 5, the application body holder 13 has a lower cylindrical portion 13*b* erected on the lower surface of the outer peripheral portion of a disc portion 13*a*, and an upper cylindrical portion 13*c* erected on the upper surface of the outer peripheral portion. The inner peripheral surface of the upper cylindrical portion 13*c* is provided with an annular recess 13*g* for engaging with the hemispherical projection 9*g* of the sleeve portion 9 in the axial direction. The inner peripheral surface of the lower cylindrical portion 13*b* serves as a portion for holding the application body 3.

The application body 3 of the application tool 12 has a substantially cylindrical shape, and is configured to include an elastic body formed of a porous material, for example, such as urethane foam and NBR. The application body 3 is obtained by planting bristles on one side surface of the elastic body, for example, such as sponge and puff. Then, in a state where the application body holder 13 is located upside down, the application body 3 enters the lower cylindrical portion 13*b*, and is held in a closely adhered state.

Next, in a state where the gripping portion 4 is located upside down, one end of the elastic body 8 is circumferentially located around the elastic body guide 4*y* of the bottom portion of the gripping portion 4. In this state, the recess 13*g* of the application body holder 13 holding the application body 3 is caused to engage with the projection 9*g* of the sleeve portion 9 in the axial direction. Subsequently, the projection thread 9*d* and the recessed groove 4*d* of the gripping portion 4 are fitted to each other. In this manner, the sleeve portion 9 is attached to the gripping portion 4 so as to be synchronously rotatable around the axis and movable in the axial direction. In this case, the other end side of the elastic body 8 is circumferentially located around the elastic body guide 9*y* of the sleeve portion 9. Then, the joining tool 5 is inserted into the cylinder wall of the gripping portion 4, and is externally fitted to the mobile body 14 having the sleeve portion 9 and the stopper portion 7. The projection 5*b* of the joining tool 5 is caused to engage with the recess 4*b* of the gripping portion 4. In this manner, the joining tool 5 is attached to the gripping portion 4 so as to be immovable in the axial direction and rotatable around the axis.

In this case, the application tool 12 (the mobile body 14 having the application body 3, the application body holder 13, the sleeve portion 9, and the stopper portion 7) is biased against the container main body 1 side by the elastic body 8. The guide object portion 7*d* of the stopper portion 7 comes into contact with the guide portion 5*d* of the joining tool 5 so as to be slidable. In this state, the elastic body 8 is in a state in which the biasing force is accumulated between the bottom portion of the gripping portion 4 and the bottom portion 9*a* of the sleeve portion 9.

Next, an operation of the cosmetic material container 100 having this configuration will be described. First, as illustrated in FIG. 1, in a case where the lid 2 is attached to the container main body 1, in a state where the mobile body 14 having the application body 3, the sleeve portion 9, and the stopper portion 7 is pulled back to the rearward movement limit (pull-back limit), the cosmetic material M and the application body 3 are separated from each other, and a space S is formed between the cosmetic material M and the application body 3, thereby bringing the cosmetic material M and the application body 3 into a non-contact state. In this case, as described above, the lid side stepped portion 5*z* is separated from and is located below the mobile body side stepped portion 9*z* while facing the mobile body side stepped portion 9*z*.

In a case where the cosmetic material container 100 is used in this state, in order to detach the lid 2, a user holds the container main body 1 and the lid 2, and rotationally operates the lid 2 in a detaching direction (loosening direction; unscrewing direction). Then, the screw portion 5*a* of the joining tool 5 of the lid 2 is fastened to the screw portion 1*a* of the container main body 1 to reach a screw limit. The container main body 1 and the joining tool 5 are integrated with each other. The gripping portion 4 is rotated with respect to the joining tool 5, and the mobile body 14 having the sleeve portion 9 and the stopper portion 7 are rotated together with the gripping portion 4. The guide object portion 7*d* of the stopper portion 7 is guided by the guide portion 5*d* of the joining tool 5. While being rotated, the guide object portion 7*d* moves to the container main body 1 side.

In this case, the sleeve portion 9 is biased against the container main body 1 side by the biasing force of the elastic body 8. Accordingly, the application tool 12 (the mobile body 14 having the application body 3, the application body holder 13, the sleeve portion 9, and the stopper portion 7) smoothly moves. Thereafter, as illustrated in FIG. 2, the application body 3 comes into contact with the cosmetic material M, and is inhibited to further move forward.

Then, if the application body 3 and the cosmetic material M come into contact with each other and the further movement is inhibited, the projection 4*s* (refer to FIG. 5) of the gripping portion 4 comes into contact with one end portion 5*x* (refer to FIGS. 5 and 6) of the cutout portion 5*s*, and the gripping portion 4 and the joining tool 5 are integrated with each other (so that they can be synchronously rotated in the same direction). Subsequently, the lid 2 is further rotationally operated in the detaching direction. In this manner, a screwing operation is performed between the screw portion 1*a* of the container main body 1 and the screw portion 5*a* of the joining tool 5. As illustrated in FIG. 3, the lid 2 is detached from the container main body 1.

In this case, the mobile body 14 having the application body 3, the application body holder 13, the sleeve portion 9, and the stopper portion 7, is pushed forward by the biasing force of the elastic body 8. The mobile body 14 is pushed out to the forward movement limit (push-out limit) which is an optimal position for use.

In this case, the mobile body side stepped portion 9*z* moves forward to the lid side stepped portion 5*z*. As illustrated in FIG. 8, the mobile body side stepped portion 9*z*, more specifically, the corner portion (edge portion) 9*t* of the stepped portion 9*z* and the tilt surface 5*r* of the inclined tilt portion 5*p* collide with each other. The application body 3 of the application tool 12 reaches the forward movement limit so that the application can be performed.

Here, line contact in which the corner portion 9*t* of the stepped portion 9*z* and the tilt surface 5*r* collide with each other reduces the contact area, compared to containers which provide surface contact between the stepped portions. Accordingly, the contact sound can be reduced. In addition, if the corner portion 9*t* of the stepped portion 9*z* collides with the tilt surface 5*r*, the contact force generated by the corner portion 9*t* of the stepped portion 9*z* coming into contact with the tilt surface 5*r* and acting in the vertical direction is divided into the force acting in the tilt direction along the tilt surface 5*r* and the force of vertically pushing the tilt surface 5*r*, and the force of vertically pushing the tilt surface 5*r* is weakened. The force is weakened, compared to containers in which the stepped portion vertically pushes the counterpart side stepped portion. Accordingly, the contact sound can be further reduced and suppressed.

Then, when in use, the user holds the lid 2, and pushes the application body 3 so as to lightly tap the application body 3 on the face of the user, for example. In this manner, the user applies a proper amount of the cosmetic material M adhering to the application body 3. While the application is performed, the application body 3 and the sleeve portion 9 are moved rearward once from the forward movement limit against the biasing force of the elastic body 8, and are immediately pushed back to the forward movement limit by the biasing force of the elastic body 8. When in use, the application body 3 is repeatedly moved rearward and forward. Here, even if the application body 3 reaches the forward movement limit, the corner portion 9*t* of the stepped portion 9*z* collides with the tilt surface 5*r*. Accordingly, for example, even if the application operation of lightly tapping the application body 3 on the face is repeatedly performed, the contact sound can be suppressed.

According to the example joining tool 5 illustrated in FIG. 6, the plurality of (here, six) tilt portions 5*p* are disposed separate from each other along the circumferential direction of the stepped portion 5*z*. Accordingly, only a few contact locations are formed between the stepped portion 9*z* and the tilt surface 5*r*. Accordingly, contact sound generating locations can be reduced, and the contact sound can be further suppressed.

After the cosmetic material container is used, in order to attach the lid 2, the user holds the container main body 1 and the lid 2, and rotationally operates the lid 2 in the attaching direction (tightening direction; screwing direction). Then, the screw portion 5*a* of the joining tool 5 of the lid 2 is screwed to the screw portion 1*a* of the container main body 1 so as to be tightened to reach the screwing limit. In this manner, the screwing operation is stopped between the screw portion 1*a* of the container main body 1 and the screw portion 5*a* of the joining tool 5. The lid 2 is attached to the container main body 1, and the container main body 1 and the joining tool 5 are integrated with each other. Subsequently, the lid 2 is further rotationally operated in the attaching direction. In this manner, the gripping portion 4 is rotated with respect to the joining tool 5, and the sleeve portion 9 and the stopper portion 7 are rotated together with the gripping portion 4. The guide object portion 7*d* of the stopper portion 7 is guided to the guide portion 5*d* of the joining tool 5. While being rotated, the guide object portion 7*d* moves to the bottom portion side of the gripping portion 4 in a direction opposite to the above-described direction. The guide object portion 7*d* is pulled back to the rearward movement limit where the projection 4*s* of the gripping portion 4 comes into contact with the other end portion 5*y* of the cutout portion 5*s*. Then, the cosmetic material M and the application body 3 are spaced apart from each other by the space S (refer to FIG. 1).

In the above example, the stopper portion 7 and the sleeve portion 9 are integrated with each other so as to form the mobile body 14. However, another configuration of the mobile body may be adopted as follows. The stopper portion is configured to include a cylindrical member which includes the guide object portion 7*d* on the outer peripheral surface and which is relatively short in the axial direction. The sleeve portion is inserted into the stopper portion so as to be synchronously rotatable with respect to the stopper portion. The guide object portion 7*d* of the stopper portion is moved by the elastic body 8 so as to be interposed between the flange portion disposed on the outer peripheral surface of the sleeve portion and the guide portion 5*d* of the joining tool 5. As a matter of course, the sleeve portion 9 may also serve as the application body holder 13.

Figure 9:
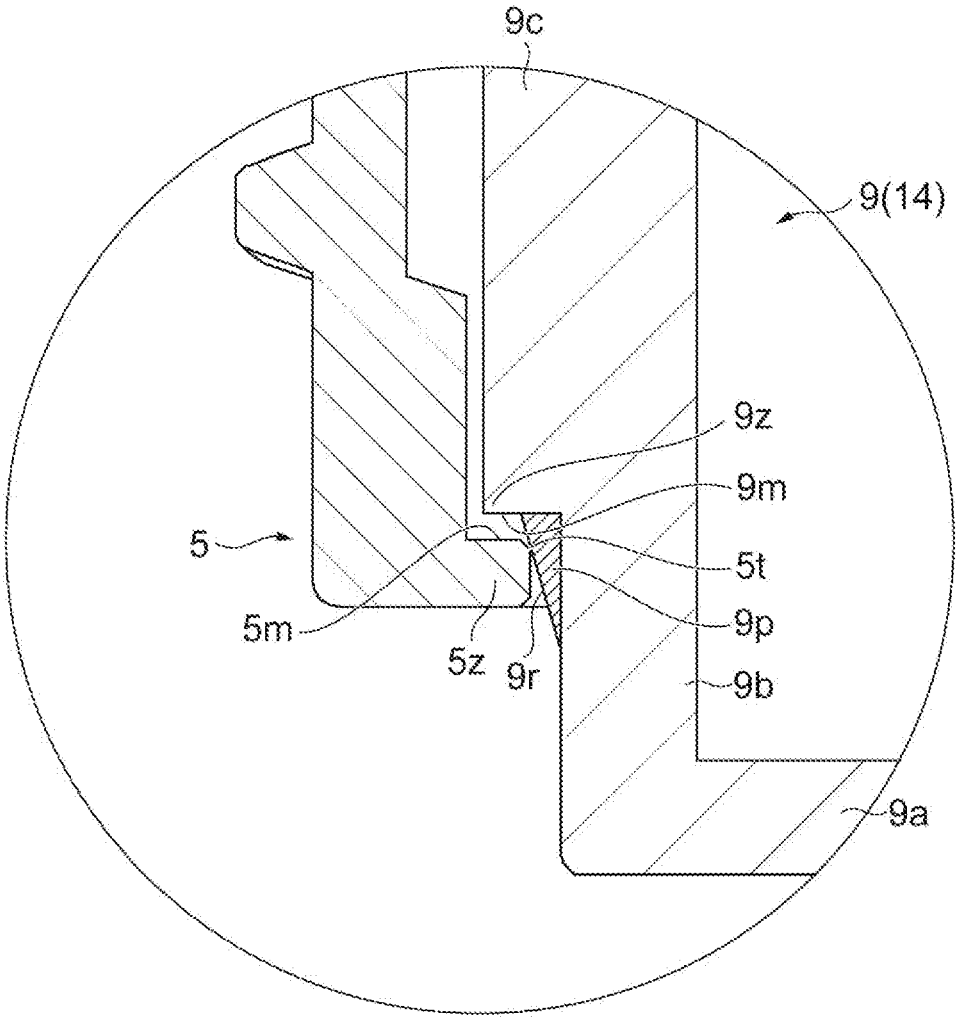
FIG. 9 is an enlarged view illustrating the portion VIII according to another example cosmetic material container.

FIG. 9 is an enlarged view illustrating the portion VIII of FIG. 3 according to another example.

Here, the inclined tilt portion 9*p* is not disposed in the lid side stepped portion 5*z*, and is instead disposed in the stepped portion 9*z* of the sleeve portion 9 of the mobile body 14. Specifically, the inclined tilt portion 9*p* is disposed on the stepped surface 9*m* of the stepped portion 9*z*. Here, the inclined tilt portions 9*p* are arranged at six positions with an equal interval along the circumferential direction. The upper end of the inclined tilt portion 9*p* is disposed to be continuous with the stepped surface 9*m*. The lower end of the inclined tilt portion 9*p* is disposed to be continuous with the outer peripheral surface of the lower cylindrical portion 9*b* of the sleeve portion 9. The inclined tilt portion 9*p* has a gradient tilting downward as the inclined tilt portion 9*p* goes inward in the radial direction. The tilt surface 9*r* of the inclined tilt portion 9*p* functions as the forward movement limit of the sleeve portion 9 (mobile body 14).

According to this configuration, the mobile body side stepped portion 9*z* moves forward to the lid side stepped portion 5*z*. As illustrated in FIG. 9, the lid side stepped portion 5*z*, specifically, the corner portion (edge portion) 5*t* of the stepped portion 5*z* and the tilt surface 9*r* of the inclined tilt portion 9*p* collide with each other. In this manner, the application body 3 of the application tool 12 reaches the forward movement limit so that the application can be performed.

The line contact where the corner portion 51 of the stepped portion 5*z* and the tilt surface 9*r* collide with each other can reduce the contact sound, compared to containers which provide the surface contact between the stepped portions. In addition, the contact force generated by the corner portion 5*t* of the stepped portion 5*z* coming into contact with the tilt surface 9*r* and acting in the vertical direction is divided into the force acting in the tilt direction along the tilt surface 9*r* and the force of vertically pushing the tilt surface 9*r*, and the force of vertically pushing the tilt surface 9*r* is weakened. Accordingly, the contact sound can be further reduced and suppressed.

In some examples, the inclined tilt portions 5*p* and 9*p* may be annularly disposed so as to be continuous along the circumferential direction of the stepped portions 5*z* and 9*z*. Accordingly, the contact area is reduced by the line contact, compared to containers which provide the surface contact between the stepped portions, and the contact sound can be reduced. In addition, compared to the force generated by the stepped portion vertically pushing the counterpart side stepped portion, the force of vertically pushing the tilt surface can be reduced, and thus, the contact sound can be suppressed.

Consequently, the force of vertically pushing the tilt surfaces 5*r* and 9*r* can be reduced based, at least in part, on the gradient or angle of the tilt surfaces 5*r* and 9*r*, and thus the contact sound can be further suppressed.

It is to be understood that not all aspects, advantages and features described herein may necessarily be achieved by, or included in, any one particular example embodiment. Indeed, having described and illustrated various examples herein, it should be apparent that other examples may be modified in arrangement and detail. For example, the cosmetic material container may include the container main body that is internally provided with the cosmetic material, the lid that is detachably attached to the upper portion of the container main body, and the application body for applying the cosmetic material. Additionally, the cosmetic material container may include the mobile body that holds the application body, and that is supported so as to be movable in the upward-downward direction with respect to the lid, and the elastic body that is interposed between the lid and the mobile body, and that biases the mobile body against the container main body side. In some examples, the lid has the lid side stepped portion disposed on the lower end side and protruding inward in the radial direction, and the mobile body has the mobile body side stepped portion facing the lid side stepped portion while being separate from the lid side stepped portion in the upward-downward direction. In some examples, when the lid is attached to the container main body, the application body and the mobile body are biased against the container main body side by the elastic body. The application body comes into contact with the cosmetic material, and the cosmetic material is brought into a state of adhering to the application body. When the lid is detached from the container main body, the application body and the mobile body are further moved forward to the forward movement limit by the elastic body so that the application can be performed. In one or more examples, either one of the lid side stepped portion on the lower end side and the mobile body side stepped portion corresponding to the stepped portion may have an inclined tilt portion tilting downward as the inclined tilt portion goes inward in the radial direction, such that the inclined tilt portion is disposed on the stepped surface forming the stepped portion (refer to FIG. 8 or 9). If the lid is detached from the container main body, the application body and the mobile body are moved forward from the lid attached position by the elastic body. Accordingly, in various examples, either one of the lid side stepped portion and the mobile body side stepped portion may be configured to collide with the tilt surface of the inclined tilt portion so as to set the forward movement limit of the application body.

Accordingly, it is possible to reduce and suppress the contact sound generated when the application body moves forward and reaches the forward movement limit. Even if the plurality of tilt portions are disposed while being separated from each other along the circumferential direction of the stepped portion, the inclined tilt portions may be continuous along the circumferential direction of the stepped portion.

In addition, for example, the elastic body 8 may comprise a coil spring. However, in other examples the elastic body 8 may comprise a stacked layer of leaf springs, a resin spring, or other types of biasing devices.

In addition, without being limited to screw-type methods of attachment and detachment, the lid 2 and the container main body 1 may be attached to or detached from each other using other methods of attachment, such as a compression or pressure fitting which may include linearly inserting and/or withdrawing the lid 2 from the container main body 1. We claim all modifications and variations coming within the spirit and scope of the subject matter claimed herein.

What is claimed is:

1. A cosmetic material container comprising:

a container main body that is internally provided with a cosmetic material;

a lid that is detachably attached to an upper portion of the container main body;

an application body for applying the cosmetic material;

a mobile body that holds the application body, and that is supported so as to be movable with respect to the lid in an upward-downward direction; and an elastic body that is interposed between the lid and the mobile body so that the mobile body is biased against the container main body side, wherein the lid has a lid side stepped portion which is disposed on a lower end side of the lid, and which protrudes inward in a radial direction, wherein the mobile body has a mobile body side stepped portion which faces the lid side stepped portion while being separated from the lid side stepped portion in the upward-downward direction, wherein in any one of the lid side stepped portion and the mobile body side stepped portion, a downward gradient tilt portion tilting downward as the tilt portion goes inward in the radial direction is disposed on a stepped surface forming the stepped portion, wherein if the lid is detached from the container main body, the application body and the mobile body are moved forward from a lid attached position by the elastic body, and wherein the other one of the lid side stepped portion and the mobile body side stepped portion and a tilt surface of the tilt portion collide with each other so as to set a forward movement limit of the application body.

2. The cosmetic material container according to claim 1, wherein the tilt portion is disposed on a stepped surface of the mobile body side stepped portion, and has a downward gradient tilting downward as the tilt portion goes inward in the radial direction, and wherein the lid side stepped portion and the tilt surface of the tilt portion moving forward collide with each other so as to set the forward movement limit of the application body.

3. The cosmetic material container according to claim 2, wherein a plurality of the tilt portions are disposed while being separated from each other along a circumferential direction of the stepped portion.

4. The cosmetic material container according to claim 2, wherein the tilt portion is annularly disposed so as to be continuous along a circumferential direction of the stepped portion.

5. The cosmetic material container according to claim 1, wherein the tilt portion is disposed on a stepped surface of the lid side stepped portion, and is a downward gradient tilting downward as the tilt portion goes inward in the radial direction, and wherein the mobile body side stepped portion moving forward and the tilt surface of the tilt portion collide with each other so as to set the forward movement limit of the application body.

6. The cosmetic material container according to claim 5, wherein a plurality of the tilt portions are disposed while being separated from each other along a circumferential direction of the stepped portion.

7. The cosmetic material container according to claim 5, wherein the tilt portion is annularly disposed so as to be continuous along a circumferential direction of the stepped portion.

8. The cosmetic material container according to claim 1, wherein a plurality of the tilt portions are disposed while being separated from each other along a circumferential direction of the stepped portion.

9. The cosmetic material container according to claim 1, wherein the tilt portion is annularly disposed so as to be continuous along a circumferential direction of the stepped portion.

10. A cosmetic material container comprising:

a container main body that is configured to have a cylindrical shape whose one end is closed, that has a first screw portion disposed on a cylinder wall, and that includes a cosmetic material; and a lid that is configured to have a cylindrical shape whose one end is closed, that has a second screw portion disposed on a cylinder wall so as to be screwable to the first screw portion, and that includes an application body, wherein the first and second screw portions are screwed to each other so that the lid is detachably attached to the container main body, wherein the lid includes a joining tool that has the second screw portion, and that has a guide portion for guiding the application body, a gripping portion that is rotationally operated by a user so as to be immovable in an axial direction with respect to the joining tool, and so as to be rotatable around an axis with respect to the joining tool, a lid side stepped portion that is disposed on a lower end side of the joining tool, and that protrudes inward in a radial direction, a mobile body that is integrated with the application body, and that has a sleeve portion which is movable in the axial direction with respect to the gripping portion and which is synchronously rotatable around the axis with the gripping portion, and a stopper portion which is synchronously rotated with the sleeve portion, which has a guide object portion guided to the guide portion by rotating the gripping portion, and which moves in the axial direction, a mobile body side stepped portion that is disposed on an outer periphery of the sleeve portion, and that faces the lid side stepped portion while being separated from the lid side stepped portion in the axial direction, and an elastic body that is interposed between the gripping portion and the sleeve portion so that the sleeve portion is biased against the container main body side, wherein in any one of the lid side stepped portion and the mobile body side stepped portion, a downward gradient tilt portion tilting downward as the tilt portion goes inward in the radial direction is disposed on a stepped surface forming the stepped portion, wherein when the lid is attached to the container main body, the stopper portion, the sleeve portion, and the application body are pulled back to a rearward movement limit, and the cosmetic material and the application body are separated from each other, wherein if the lid is rotationally operated in a direction in which the lid is detached from the container main body, the guide object portion of the stopper portion is guided to the guide portion of the joining tool, and the stopper portion, the sleeve portion, and the application body are moved to the container main body side so that the cosmetic material and the application body come into contact with each other, wherein if the rotational operation is continuously operated in the same direction, the gripping portion and the joining tool are integrated with each other, a screwing operation is performed between the first and second screw portions so that the lid is detached from the container main body, the sleeve portion is biased to a forward movement limit located in a direction different from that of the rearward movement limit by the elastic body, and the other one of the lid side stepped portion and the mobile body side stepped portion and a tilt surface of the tilt portion collide with each other so that the application body reaches the forward movement limit, wherein if the lid is rotationally operated in a direction in which the lid is attached to the container main body, the screwing operation is performed between the first and second screw portions so that the lid is attached to the container main body, and wherein if the screwing operation is stopped between the first and second screw portions, the gripping portion and the joining tool become rotatable, the guide object portion of the stopper portion is guided to the guide portion of the joining tool, and the stopper portion, the sleeve portion, and the application body are pulled back to the rearward movement limit so that the cosmetic material and the application body are separated from each other.

11. The cosmetic material container according to claim 10, wherein the tilt portion is disposed on a stepped surface of the lid side stepped portion, and is a downward gradient tilting downward as the tilt portion goes inward in the radial direction, and wherein the mobile body side stepped portion moving forward and the tilt surface of the tilt portion collide with each other so as to set the forward movement limit of the application body.

12. The cosmetic material container according to claim 11, wherein the tilt portion is annularly disposed so as to be continuous along a circumferential direction of the stepped portion.

13. The cosmetic material container according to claim 11, wherein a plurality of the tilt portions are disposed while being separated from each other along a circumferential direction of the stepped portion.

14. The cosmetic material container according to claim 10, wherein the tilt portion is disposed on a stepped surface of the mobile body side stepped portion, and has a downward gradient tilting downward as the tilt portion goes inward in the radial direction, and wherein the lid side stepped portion and the tilt surface of the tilt portion moving forward collide with each other so as to set the forward movement limit of the application body.

15. The cosmetic material container according to claim 14, wherein a plurality of the tilt portions are disposed while being separated from each other along a circumferential direction of the stepped portion.

16. The cosmetic material container according to claim 14, wherein the tilt portion is annularly disposed so as to be continuous along a circumferential direction of the stepped portion.

17. The cosmetic material container according to claim 10, wherein a plurality of the tilt portions are disposed while being separated from each other along a circumferential direction of the stepped portion.

18. The cosmetic material container according to claim 10, wherein the tilt portion is annularly disposed so as to be continuous along a circumferential direction of the stepped portion. stepped portion.

* * * * *